United States Patent [19]

Laycock

[11] Patent Number: 4,589,524

[45] Date of Patent: May 20, 1986

[54] OVERFILL VALVE

[75] Inventor: John E. Laycock, San Diego, Calif.

[73] Assignee: Sundstrand Corporation, Rockford, Ill.

[21] Appl. No.: 753,201

[22] Filed: Jul. 9, 1985

[51] Int. Cl.[4] ..... F01M 11/12

[52] U.S. Cl. ..... 184/103.1

[58] Field of Search ..... 184/6.3, 6.4, 6.12, 184/1.5, 103 R, 103 A, 106, 108; 123/196 CP; 137/393, 395

[56] References Cited

U.S. PATENT DOCUMENTS

| | | | |
|---|---|---|---|
| 3,033,311 | 5/1962 | Edgar et al. | 184/1.5 |
| 4,091,894 | 5/1978 | Lang | 184/103 R |
| 4,091,895 | 5/1978 | Lang | 184/103 R |
| 4,495,963 | 1/1985 | Hensley | 137/351 |

FOREIGN PATENT DOCUMENTS

| | | | |
|---|---|---|---|
| 726036 | 8/1942 | Fed. Rep. of Germany | 184/103 R |
| 1037784 | 8/1958 | Fed. Rep. of Germany | 184/103 R |
| 3041373 | 6/1981 | Fed. Rep. of Germany | 184/1.5 |
| 244945 | 12/1925 | United Kingdom | 184/103 R |
| 842654 | 7/1960 | United Kingdom | 184/103 R |

*Primary Examiner*—Leonard E. Smith

*Attorney, Agent, or Firm*—Harold A. Williamson; Ted E. Killingsworth; James A. Wanner

[57] ABSTRACT

The age old problem of monitoring a liquid level in a reservoir has continued to cause problems. If the level is too low, the component will malfunction due to lack of lubricant; on the other hand, if the level is too high, the component can overheat. The present system overcomes the problem of the level being too high by providing an automatic vent for draining excess liquid from the reservoir. When the engine is in the nonoperating mode, the spring moves the spool of the valve to the open position. In the open position, excess liquid is vented from the reservoir establishing the predetermined liquid level. When the engine is operating, a portion of the air from the compressor enters the chamber forcing the spool to the closed position preventing liquid from being vented from the reservoir. In the closed position, contaminants are also prevented from entering the reservoir. The present invention overcomes the problem of overfilling a reservoir by venting excess liquid from the reservoir when the engine is in the nonoperating mode.

2 Claims, 2 Drawing Figures

OVERFILL VALVE

DESCRIPTION

1. Technical Field

This invention relates generally to the controlling of a liquid level within a reservoir and more particularly to the venting of excess liquid from the reservoir.

2. Background Art

Lubrication systems are required to lubricate the moving components of an apparatus and to carry heat away from the contact surfaces of the moving components. Many lubrication systems use a liquid to perform the lubricating and cooling function. The liquid is normally contained in a reservoir and must be maintained at a predetermined level to function properly. While it is apparent what will happen when the liquid level drops below the predetermined level, many people do not realize that overfilling above the predetermined level also creates a problem. For example, in many apparatuses one or more of the moving components extend into the liquid. If the liquid level is too high, the excess liquid can cause foaming of the liquid. Such foaming reduces the cooling capability of the liquid and usually results in an increase in the operating temperature. Some apparatuses are provided with temperature sensors which automatically shut down the apparatus if the operating temperature becomes too high. The operator must then wait until the apparatus cools down before the apparatus can be put back into operation.

One common device used to monitor the liquid level in a reservoir is a dipstick. The dipstick is normally marked with a full mark and an add mark to indicate if any liquid should be added. One of the problems with a dipstick is that it must be removed from the reservoir to visually observe the liquid level thereon. Thus, the dipstick cannot be used to continuously monitor the level of the liquid as liquid is being added to the reservoir. Thus, quite frequently excess liquid is added to the reservoir particularly if the amount of liquid needed to bring the level up to the full mark is less than the amount of liquid in the container from which the liquid is being added.

The use of a sight gauge can overcome this problem since the fluid level rises as the liquid is added and the level can be observed. To be effective the sight gauge must be located in a maintenance person's line of sight. However, in many of today's applications it is not possible to locate the sight gauge in an operator or maintenance person's line of sight because of noise enclosures and other obstructions. If the sight gauge is not readily visible, an excess amount of liquid can be inadvertently added to the reservoir. Thus, with both the dipstick and sight gauge the maintenance person must be diligent to prevent the inadvertent overfilling of the reservoir.

Systems have been devised to control the predetermined level by automatically adding liquid when this level is below the appropriate predetermined level. Such systems are complex and require an additional reservoir for the makeup liquid. The space required for such reservoirs in many cases prevents the use of such systems. U.S. Pat. No. 4,091,894 issued to James R. Lang discloses such a system for maintaining a desired level of fluid in a sump of an engine.

The present invention is directed to overcoming one or more of the problems set forth above.

DISCLOSURE OF THE INVENTION

In one aspect of the invention, a system is provided to vent excess liquid from a reservoir of an apparatus when the liquid exceeds a predetermined level. The apparatus has an operating and nonoperating mode. The system includes a means for forming a vent passage from the reservoir and a valve movable between an open position at which excess liquid in the reservoir is vented through the vent passage and a closed position at which communication through the vent passage is blocked. The system also includes means for moving the valve to the open position when the apparatus is in the nonoperating mode and means for moving the valve to the closed position in response to the apparatus being in the operating mode.

In another aspect of the invention an engine has an operating and a nonoperating mode and includes a reservoir containing a liquid at a predetermined level, means for forming a vent passage from the reservoir and a valve movable between an open position at which liquid in excess of the predetermined level is vented and a closed position at which communication through the vent passage is blocked. Also included are means for moving the valve to the open position when the engine is in the nonoperating mode and means for moving the valve to the closed position in response to the engine being in the operating mode.

The present invention provides a system having an open position for automatically venting excess liquid from a reservoir when the apparatus is in the nonoperating mode and a closed position at which communication from the reservoir is blocked. This automatic venting system prevents overfill of the reservoir and thus the overheating problem associated therewith when the reservoir is overfilled.

BEST MODE FOR CARRYING OUT THE INVENTION

Figure 1:
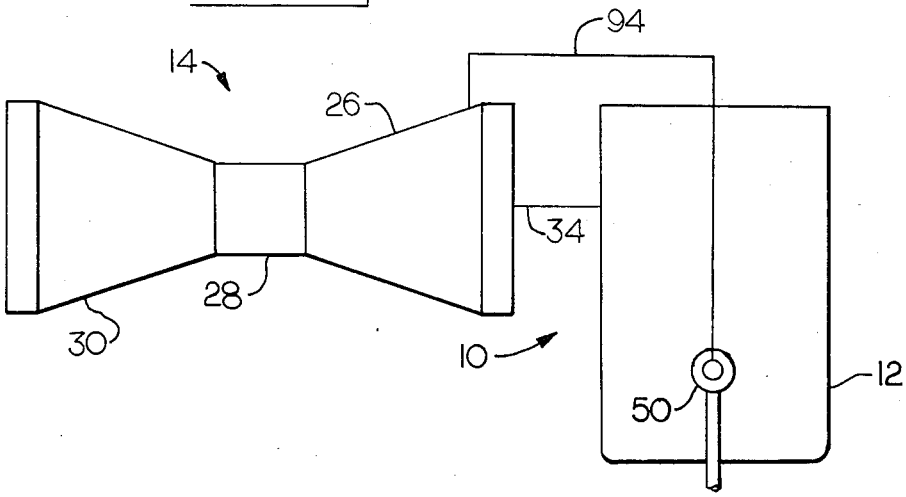
FIG. 1 is a schematic drawing of an embodiment of the present invention.
Figure 2:
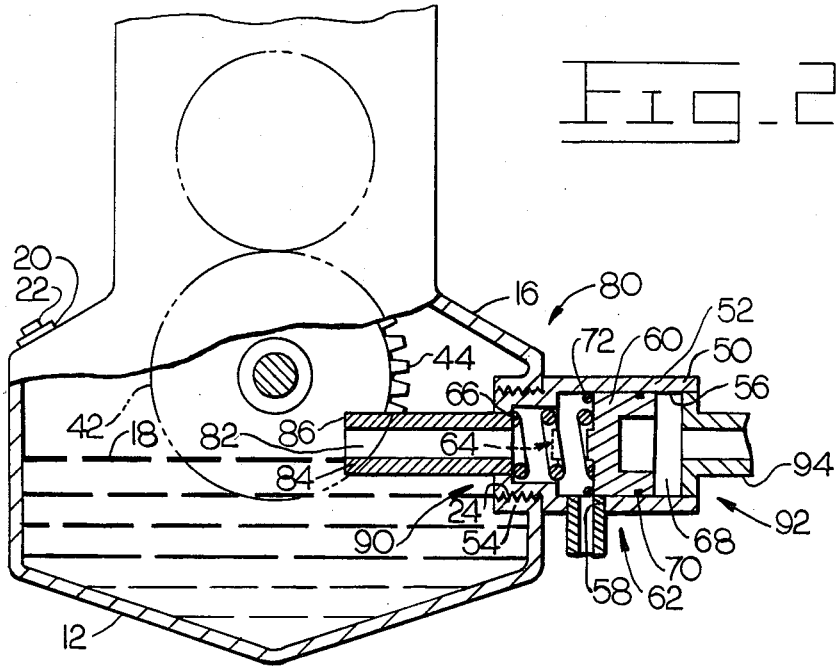
FIG. 2. is an enlarged partially sectional view of a reservoir and a valve of the present invention.

Referring now to the drawings, a system 10 is provided to vent excess liquid from a reservoir 12 of an apparatus 14 which has an operating mode and a nonoperating mode.

The reservoir 12 includes a housing 16 and contains a lubricating liquid at a predetermined level 18 therein. The housing 16 includes a filler opening 20, a plug 22 disposed in the filler opening 20 and a threaded bore 24 centered slightly above the predetermined liquid level 18.

The apparatus 14 disclosed in this embodiment is a gas turbine engine including a pressure source or an air compressor 26 supplying combustion air to the engine 14, a combustor 28, a turbine 30 and a power output shaft 34 drivingly connected to a gear train 42 having a plurality of gears 44 mounted within the housing 16. A portion of one of the plurality of gears 44 extends below the predetermined liquid level 18. Alternatively, the apparatus 14 could be a gasoline or diesel engine wherein the reservoir 12 would be the crankcase thereof.

A valve 50 includes a body 52 and has a threaded end 54 attached within the threaded bore 24 of the housing 16. The body 52 has a first stepped bore 56 and a second bore 58 intersecting the first bore 56. A spool 60 is slidably positioned within the first bore 56 and moves between an open position 62 and a closed position 64. A spring 66 is positioned in the first bore 56 at one end of the spool and biases the spool 60 to the open position 62. A chamber 68 is defined in the first bore 56 at the end of the spool 56 opposite the spring 66. The spool 56 is provided with a first annular seal 70 between the spool 56 and the body 52. A second annular seal 72 is connected to the spool 56 at the end opposite the chamber 68 for sealing contact with the body 52 at the closed position of the spool. Alternatively, the second annular seal 72 can be deleted and the spool 56 provided with a seal surface formed thereon suitable for sealing contact with the body 52.

A means 80 is provided for forming a vent passage 82 from the reservoir 12 and includes a tube 84 having a first end 86 and a second end 88. The first end 86 extends into the reservoir 12 to a position approximately centered therein and at the predetermined level 18 of the liquid. The second end 88 of the tube 84 is connected to the body 52 of the valve 50. The vent passage 82 communicates with the first bore 56 in the body 52 of the valve 50. Alternatively, the tube 84 could be formed as a part of the housing 16.

A means 90 is provided for moving the valve 50 to the open position 62 when the engine 14 is in the nonoperating mode and includes the spring 66.

A means 92 is provided for moving the valve 50 to the closed position 64 in response to the apparatus 14 being in the operating mode and includes the pressure source or the compressor 26 continuously operable when the engine 14 is in the operating mode and a conduit 94 communicating between the pressure source 26 and the chamber 68 of the valve 50. As an alternative, the conduit 94 could be connected to a secondary pressure source such as a hydraulic pump. In yet another alternative, the means 92 could be an electrically activated solenoid connected to the spool 56 and to an electrical source available only when the engine is in the operating mode.

Industrial Applicability

The engine 14 used in this application is located within the sheet metal and structure of a helicopter. The engine 14 and gear train 42 combination is an auxiliary power plant used for supplying air pressure and hydraulic pressure when the helicopter main engine is not running. The system 10 is used to vent excess liquid from the reservoir 12 containing the gear train 42. When a maintenance person adds oil to the reservoir 12, the engine 14 is in the nonoperating mode. Since the compressor 26 is not functioning, the spring 66 within the first bore 56 moves the spool 60 to the open position 62 in which the vent passage 82 is in communication with the second bore 58. The maintenance person removes the plug 22 from the filler opening 20 and adds oil to the reservoir 12. Once the liquid level reaches the predetermined level, any excess oil subsequently added is vented from the reservoir 12 through the tube 84, first bore 56 and out the second bore 58. The first end 86 of the tube 84 extends into the reservoir 12 to a position approximately centered therein and at the predetermined level of oil so that if the helicopter should be on a slope the correct predetermined level of oil 18 is obtained in the reservoir 12. After completing the filling exercise, the maintenance person reinstalls the plug 22 the filler opening 20.

When the engine 14 is in the operating mode, a portion of the air from the compressor 26 is communicated through the conduit 94 to the chamber 68 in the valve 50. The spool 56 is moved to the closed position 64 by the air and the second annular seal 72 blocks the vent passage 82 from communication with the second bore 58.

The vent system 10 eliminates the problem of inadvertently adding too much liquid to a reservoir which occasionally happens when a dipstick or sight gauge is used to monitor the level of the liquid. At the time any liquid is added to the reservoir, a vent passage is normally open so that any excess liquid added to the reservoir is immediately vented therefrom. Thus, the problem of overheating which usually occurs when the reservoir is overfilled is also eliminated.

Other aspects, objects and advantages of this invention can be obtained from a study of the drawings, the disclosure and the appended claims.

I claim:

1. An engine having an operating and a non operating mode and including a reservoir containing a liquid to be maintained at a predetermined level irrespective of a sloping attitude the engine and reservoir may be at, comprising:

means for forming a vent passage from the reservoir, a valve attached to the reservoir and movable between an open position at which liquid in excess of the predetermined level is vented through the vent passage and a closed position at which communication through the vent passage is blocked, said means forming said vent passage including a tube having a first end extending into the reservoir to a position approximately centered therein and at the predetermined level of the liquid and a second end connected to said valve, to thereby ensure that the predetermined level in the reservoir is maintained, said valve including a body having a first bore and a second bore intersecting the first bore, said vent passage communicating with the first bore, and a spool slideably positioned within the first bore and movable between the open position in which the vent passage is in communication with the second bore and the closed position in which the vent passage is blocked from communication with the second bore, said valve including a chamber in the first bore at one end of the spool, a single spring means for moving the valve to the open position when the engine is in the non operative mode, said single spring means positioned in the first bore at the other end of the spool, means for moving the valve to the closed position in response to the engine being in the operating mode, said means for moving the valve to the closed position including a conduit communicating between a pressure producing means driven by the engine in the operating mode and the chamber in the first bore at said one end of the spool, said pressure acting upon said valve to cause said valve to move against said single spring means while said valve simultaneously blocks said vent passage to thereby establish an engine reservoir that may be supplied with liquid in any amount during the non operating mode without the risk of overfilling the reservoir while assuring that irrespective of the position of the engine and the slope of the liquid level with respect to the horizontal, said liquid level is always uniformly controlled as a consequence of said vent passage tube first end position in said reservoir when the engine is non operative, whereas the moment said engine enters the operative mode liquid is prevented from passing through said vent passage.

2. The engine of claim 1 wherein said pressure producing means is a compressor which supplies pressurized air for combustion during said operating mode, said compressor coupled to said conduit to provide said pressurized air to said chamber in said first bore at said one end of the spool.

* * * * *